US006804863B2

(12) United States Patent
Henninger

(10) Patent No.: US 6,804,863 B2
(45) Date of Patent: Oct. 19, 2004

(54) MOUNTING FOR A COMBING CYLINDER

(75) Inventor: Friedrich Henninger, Flachslanden (DE)

(73) Assignee: Staedtler & Uhl, Schwabach (DE)

( * ) Notice: Subject to any disclaimer, the term of this patent is extended or adjusted under 35 U.S.C. 154(b) by 0 days.

(21) Appl. No.: 10/433,098

(22) PCT Filed: Oct. 17, 2001

(86) PCT No.: PCT/EP01/12014

§ 371 (c)(1),
(2), (4) Date: May 30, 2003

(87) PCT Pub. No.: WO02/44449

PCT Pub. Date: Jun. 6, 2002

(65) Prior Publication Data

US 2004/0025301 A1 Feb. 12, 2004

(30) Foreign Application Priority Data

Nov. 30, 2000 (DE) ..... 100 59 602

(51) Int. Cl.[7] ..... D01G 15/84
(52) U.S. Cl. ..... 19/114
(58) Field of Search ..... 19/115 R, 112, 19/113, 114, 233, 234, 215, 217

(56) References Cited

U.S. PATENT DOCUMENTS 4,398,318 A * 8/1983 Ashworth, III ..... 19/114
4,606,095 A 8/1986 Egerer
6,353,974 B1 * 3/2002 Graf ..... 19/234
6,604,260 B1 * 8/2003 Henninger ..... 19/114

FOREIGN PATENT DOCUMENTS

| | | | |
|---|---|---|---|
| DE | 299 13 366 | 10/1999 | |
| EP | 0 179 158 | 10/1984 | |
| EP | 0 382 899 | 11/1989 | |
| EP | 1 083 250 | 7/2000 | |
| GB | 872151 | 7/1961 | |
| GB | 1 580 045 | * 11/1980 | ..... D01G/19/04 |

OTHER PUBLICATIONS

Translated Abstrast of EP 0 179 158.*

* cited by examiner

*Primary Examiner*—Gary L. Welch
(74) *Attorney, Agent, or Firm*—Browdy and Neimark, P.L.LC.

(57) ABSTRACT

In porcupine clothing for textile machines, in particular combing machines, comprising a plurality of combing segments disposed one after the other in the direction of rotation of the porcupine, each combing segment being formed by successive serrated punched cut-outs with a root and with teeth that face away from the root, with the configuration of the teeth of the clothing changing in the direction of rotation, it is provided that the clothing (1), in its entirety, is embodied such that the parameters which include the distance (T) between the teeth (13) and/or the angle of engagement (E) and/or the free passage (D) between the teeth (13) and/or the height (H) of the teeth (13) change at varying angular positions seen in the circumferential direction of the clothing (1).

1 Claim, 3 Drawing Sheets

MOUNTING FOR A COMBING CYLINDER

BACKGROUND OF TEE INVENTION

1. Technical Field

Porcupine clothing for textile machines, in particular combing machines, comprising a plurality of combing segments disposed one after the other in the direction of rotation of the porcupine, each combing segment being formed by successive serrated punched cut-outs with a root and with teeth that face away from the root, with the configuration of the teeth of the clothing changing in the direction of rotation.

2. Prior Art

Clothing of the generic type is known from EP 0 179 158 which provides for a configuration of the tips within a single serrated punched cut-out such that the height of the tips, the angle of engagement and the distance of the tips from each other increase in the direction of rotation. The corresponding progressive change ensures gentle penetration into, as well as relaxation and lifting of, the sliver.

DE 299 13 366 describes clothing in which the segment that first penetrates the sliver in the direction of rotation has a combing effect inferior to that of the subsequent segments that pass through the sliver, with the subsequent segments, in the circumferential direction, having a greater length than the leading segment. However, this dimensioning in the circumferential direction and a progressive height or density of serration are not sufficient for optimal combing results.

OBJECT AND SUMMARY OF THE INVENTION

It is an object of the invention to improve the prior art card clothing and optimize the combing result.

According to the invention, this object is attained in that the clothing, in its entirety, is embodied such that the parameters which include the distance between the teeth and/or the angle of engagement of the respective tooth flank and/or the free passage between the teeth and/or the height of the teeth change at varying angular positions in the circumferential direction of the clothing.

The design, according to the invention, of the clothing enables short fibers to be gently removed by combing. Moreover, the general combing result has been found to be clearly improved as against comparable clothing. The comparatively finely differentiated structure of the configuration according to the invention has proved suprisingly efficient.

BRIEF DESCRIPTION OF THE DRAWINGS

Details of the invention will become apparent from the ensuing description of a preferred embodiment, taken in conjunction with the drawing, in which.

DETAILED DESCRIPTION OF THE PREFERRED EMBODIMENT(S) OF THE INVENTION

Figure 1:
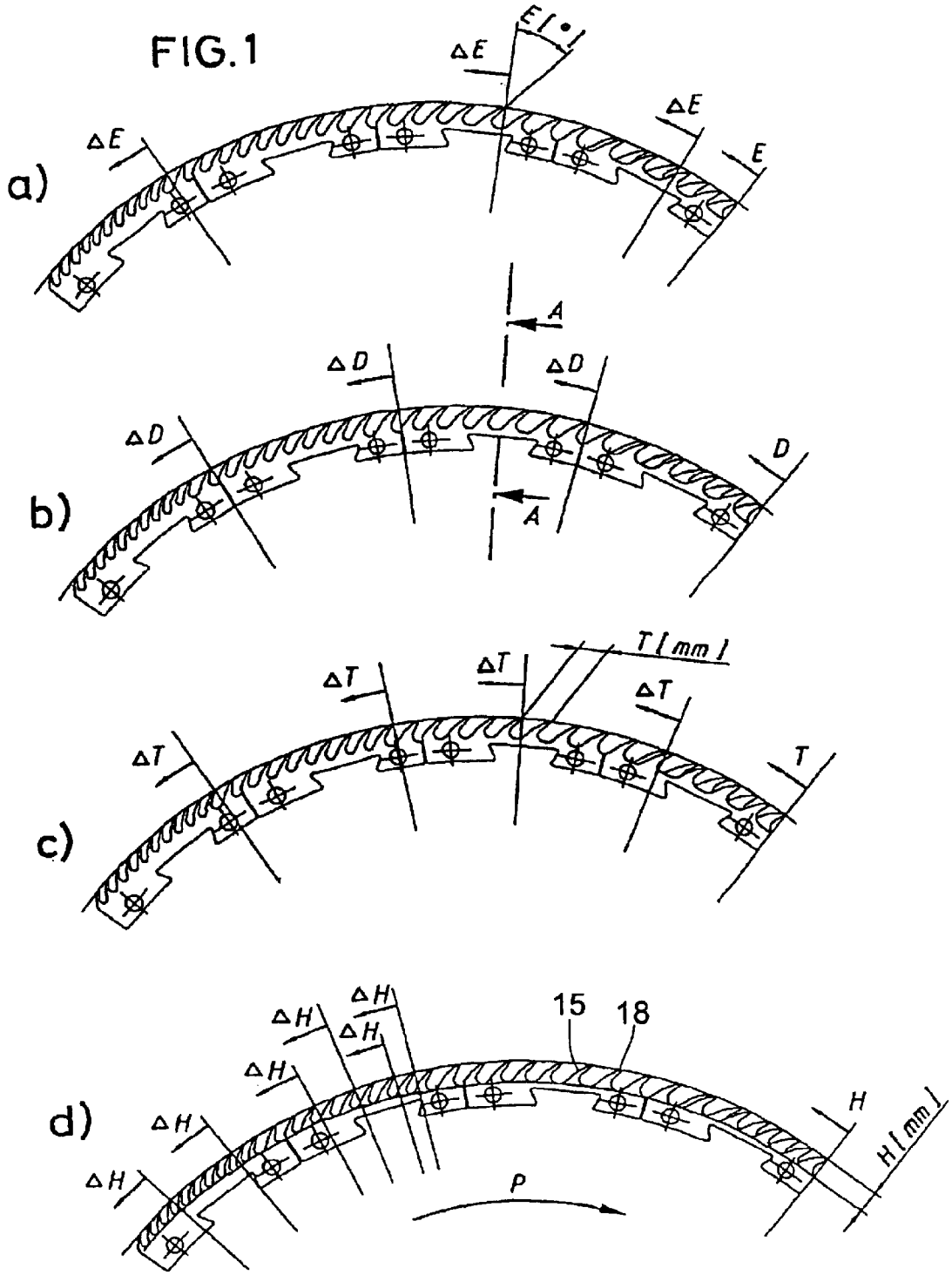
FIG. 1 comprises diagrammatic illustrations of clothing for explanation of the parameters involved according to the invention.

In the exemplary embodiment, the card clothing 1, as seen in the drawing, for a cylindrical comb (not shown) includes four detents 2, 3, 4, 5 which are disposed one after the other in the direction of rotation (arrow P), each comprising successive serrated punched cut-outs 6, 7, 8, 9. Lining up and retaining the serrated punched cut-outs 6, 7, 8, 9 is implemented in a manner known per se by dove-tail grooves 10 and drilled holes 11 disposed by the side thereof.

Each serrated punched cut-out 6, 7, 8, 9 comprises a root 12 where the recesses 10, 11 are formed and a plurality of teeth 13 that face away from the root 12 outwards approximately in the radial direction.

These teeth 13 slope in the direction of rotation (arrow P), having a leading flank 14 that first penetrates into the sliver, and a rear flank 15.

The configuration of these teeth 13 as compared to the preceding and succeeding teeth and to the teeth 13 beside them seen in the direction of the axis of rotation can be described by various parameters which will be explained in conjunction with FIG. 1:

A first parameter is the angle of engagement E of the leading tooth flank 14 i.e., the angle made by this leading flank 14 and the radial direction R. This parameter E is illustrated in FIG. 1*a*.

As seen in FIG. 1*b*, another parameter is the free passage D between two teeth 13 or serrated punched cut-outs 6, 7, 8, 9 which lie side by side within one and the same detent 2, 3, 4, 5.

The distance T between two neighboring teeth in the direction of combing (arrow P) is another parameter seen in FIG. 1*c*.

Finally, FIG. 1*d* illustrates the height H of the teeth as a parameter. The height H is measured between the fictitious upper edge 16 of the root 12 and the external envelope curve 17 of the tips 18 of the serration.

Figure 2:
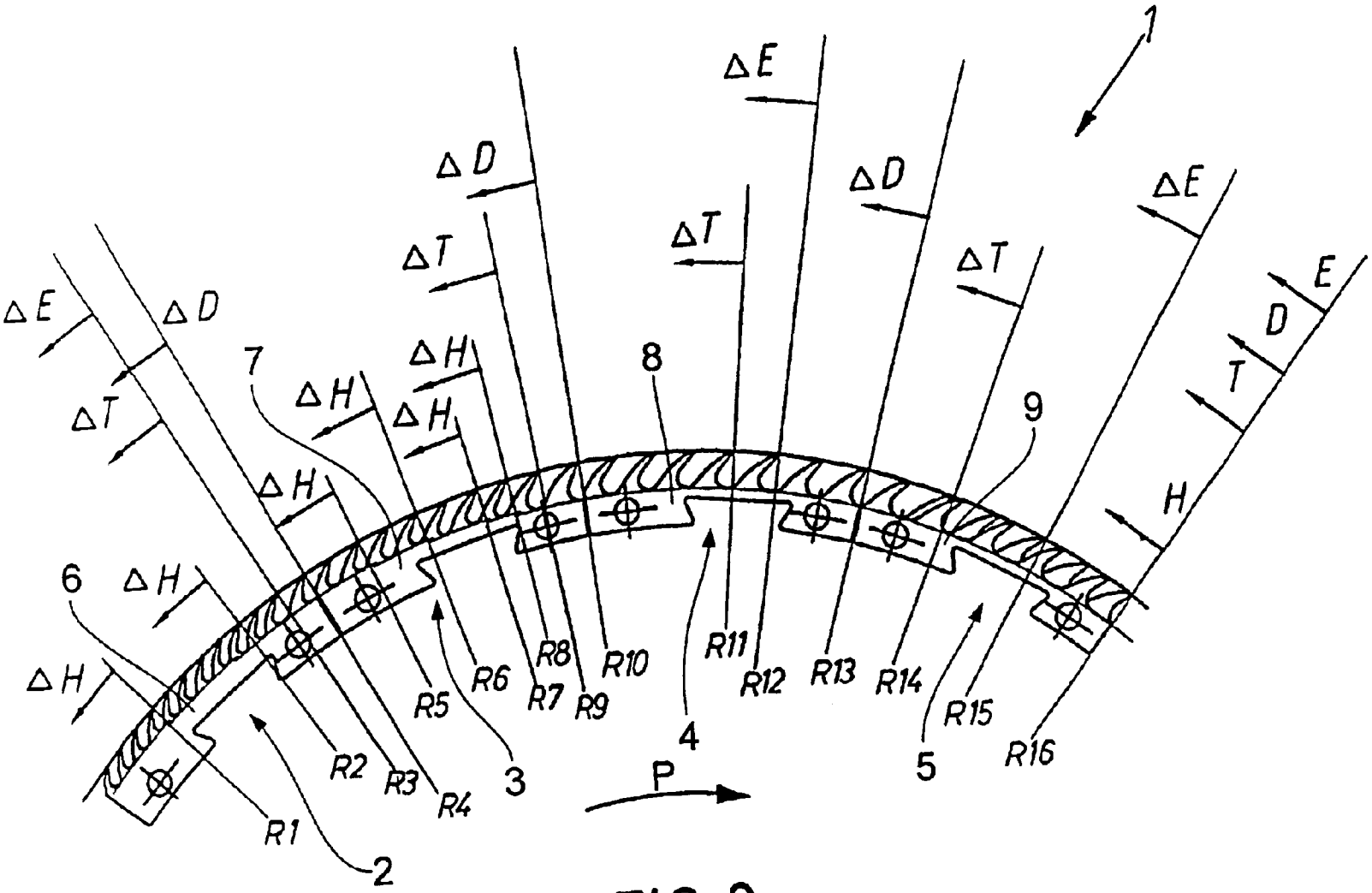
FIG. 2 is a view of a first embodiment of the clothing according to the invention.
Figure 3:
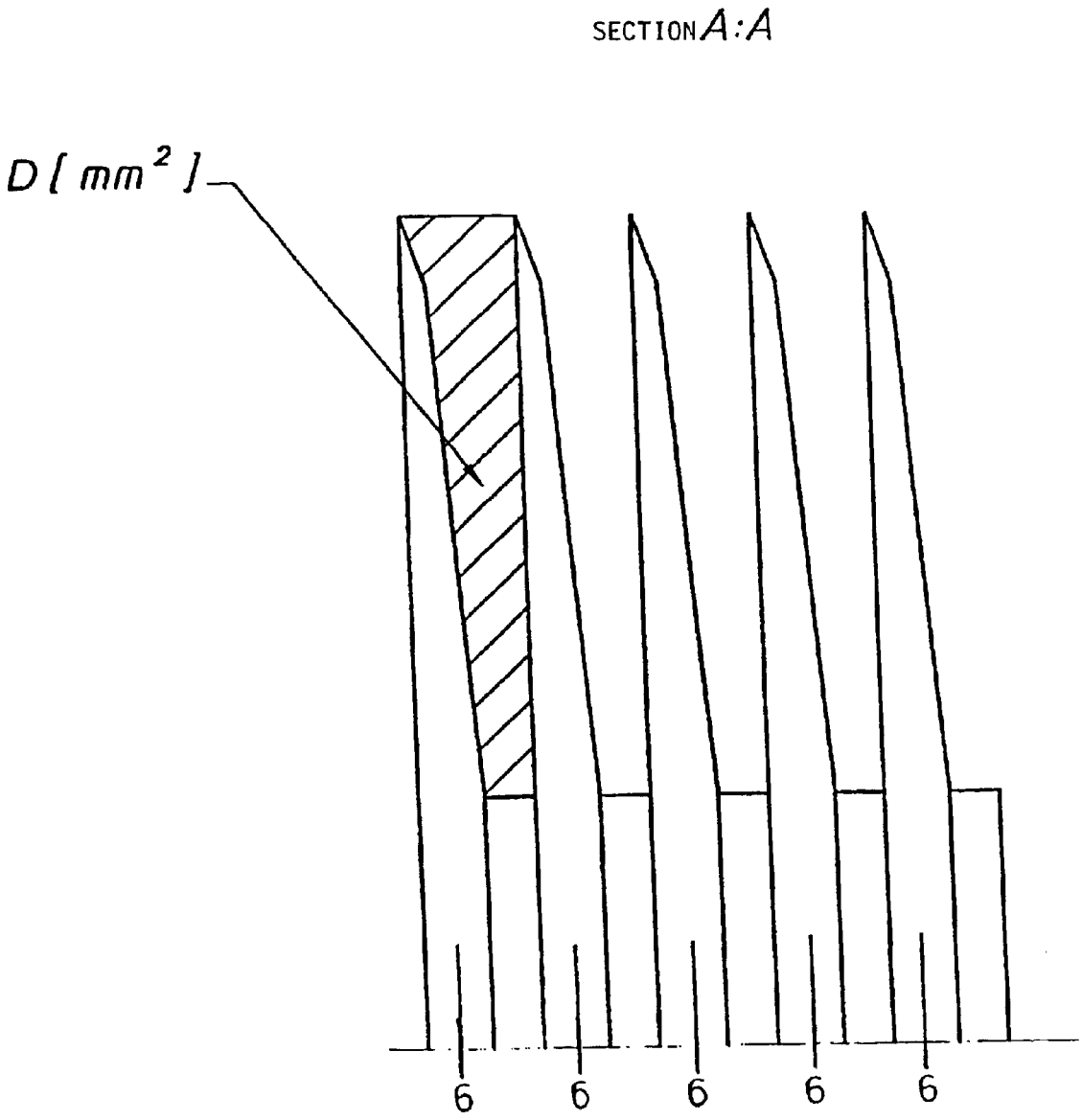
FIG. 3 is a sectional view on the line A—A of FIG. 1.

FIG. 2 shows a first embodiment of the clothing 1 according to the invention wherein one of the serration parameters, namely the angle of engagement E, the free passage D, the distance T and the height H, changes at varying angular positions with each of the radiuses R1 to R16 that are plotted successively in the direction of combing (arrow P) so that, seen in the direction of combing, the height H increases, the free passage D increases, the distance T increases and the angle of engagement E decreases.

What is claimed is:

1. In a porcupine clothing for textile machines, comprising a plurality of combing segments disposed one after the other in the direction of rotation of the porcupine, each combing segment being formed by successive serrated punched cut-outs with a root and with teeth that face away from the root, with the configuration of the teeth of the clothing changing in the direction of rotation, the improvement wherein the clothing (1), in its entirety, is embodied such that at least two of the parameters which include the distance (T) between the teeth (13) and/or the angle of engagement (E) and/or the free passage (D) between the teeth (13) and/or the height (H) of the teeth (13) change at varying angular positions in the circumferential direction of the clothing (1) such that seen in the direction of combing (arrow P), the height (H) of the teeth (13) increases, the free passage (D) decreases, the distance (T) between the teeth (13) increases and the angle of engagement (E) decreases.

* * * * *